United States Patent [19]

Wainer

[11] 4,157,896

[45] Jun. 12, 1979

[54] APPARATUS FOR THE PRODUCTION OF CARBON MONOXIDE AND HYDROGEN

[75] Inventor: Eugene Wainer, Shaker Heights, Ohio

[73] Assignee: Horizons Research Incorporated, Cleveland, Ohio

[21] Appl. No.: 838,012

[22] Filed: Sep. 29, 1977

Related U.S. Application Data

[62] Division of Ser. No. 702,003, Jul. 2, 1976, Pat. No. 4,074,980.

[51] Int. Cl.[2] ..... C10J 3/48; C10J 3/56

[52] U.S. Cl. ..... 48/62 R; 48/73; 48/65; 422/142

[58] Field of Search ..... 48/197 R, 202, 210, 48/61, 62 R, 73, 65, 77, 89, 99, 101; 423/415 A, 457; 252/373; 75/66; 23/252 R, 281

[56] References Cited

U.S. PATENT DOCUMENTS

| | | | |
|---|---|---|---|
| 2,094,946 | 10/1937 | Hubmann | 48/65 |
| 2,127,542 | 8/1938 | Stitzer | 48/65 |
| 2,868,631 | 1/1959 | Woebcke | 48/210 |
| 2,996,375 | 8/1961 | Wolkoff | 75/66 |
| 3,941,681 | 3/1976 | Saegusa et al. | 48/197 R |
| 4,029,481 | 6/1977 | Oliver et al. | 48/73 |

*Primary Examiner*—S. Leon Bashore
*Assistant Examiner*—Peter F. Kratz
*Attorney, Agent, or Firm*—Lawrence I. Field

[57] ABSTRACT

Carbon monoxide and hydrogen are produced by spraying a mixture of molten sodium and/or potassium from one nozzle into a chamber maintained at a temperature of 650° C. to 850° C. along with one or more separated sprays containing a slurry of carbon, water and carbon dioxide so that the various sprays contact each other in said hot chamber so constructed so that the reactants are forced into a suitably constructed reactor containing iron and/or its oxide in a semifluid bed powdered condition. Preferably, the reactor contains mixtures of the metals and/or oxides taken from the class of iron, cobalt, nickel and manganese. In a cyclic reaction, the metallic sodium is reconstituted along with continued production of carbon monoxide and hydrogen, the iron type component remaining in the reactor which as a consequence of the reagents and conditions is cyclically oxidized to oxides of iron type elements and reduced to finely divided iron and/or mixtures of iron, cobalt, nickel and manganese. The sodium vapor is condensed rapidly and the carbon monoxide and hydrogen passes to a gas holder. The incoming reagents are fed to the reactor at a temperature of 350° C. to 380° C., which temperature is maintained by appropriate heat exchange obtained from the heat contained in the reaction products. The reconstituted alkali metal is recycled through the reactor along with the preheated and added carbon, carbon dioxide and water. Siliceous ash is extracted from the reactor periodically as a finely divided non-fused powder, principally in the form of calcium metasilicate produced as a consequence of adding finely divided limestone to the reaction mixture.

6 Claims, 4 Drawing Figures

APPARATUS FOR THE PRODUCTION OF CARBON MONOXIDE AND HYDROGEN

Figure 1:
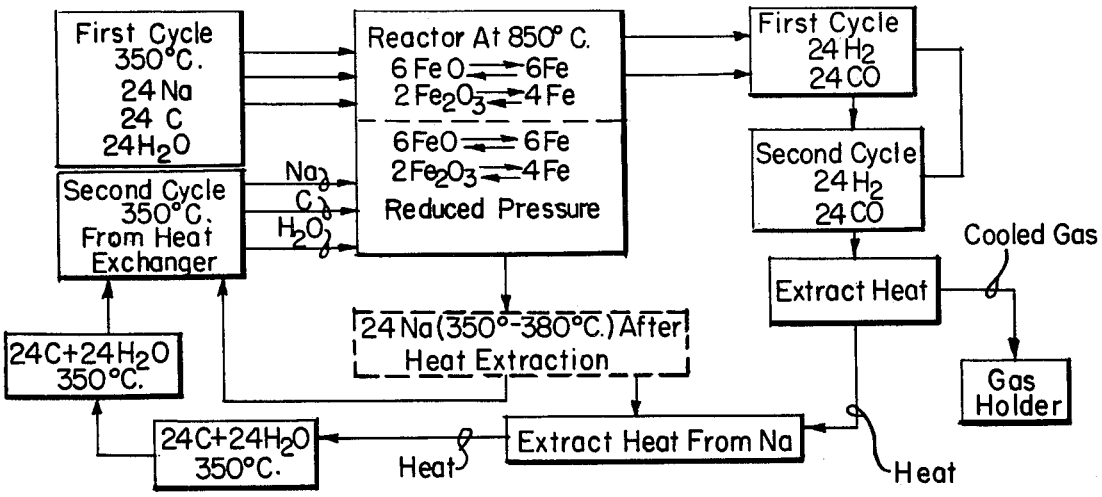

This is a division, of application Ser. No. 702,003, filed July 2, 1976 now U.S. Pat. No. 4,074,980.

BACKGROUND AND PRIOR ART

The chemistry of the process is based principally on the technique of production of the alkali metals by thermal processes. An excellent review of the techniques for the thermal production of the alkali metals by reduction of an appropriate combination of the compounds of the alkali metals with a reducing agent is given on pages 308 through 327 of "Mellors Comprehensive Treatise on Inorganic and Theoretical Chemistry," Vol. 2, Supplement 2, Longman's, Green and Company, Ltd., London, 1961, (John Wiley & Sons Incorporated, New York). Further information on the chemistry of the thermal production of the alkali metals from their compounds is given in "Comprehensive Inorganic Chemistry," M. C. Sneed and R. C. Braested, Vol. 6, 1957, D. VanNostrand Company, Princeton, N. J. and also in "The Encyclopedia of Chemical Reactions," by C. A. Jacobson, Rheinhold Publishing Corporation, New York, 1956.

Much of the useful information referred to in these encyclopedic compendia is covered more specifically in various issued patents as follows:

U.S. Pat. No. 1,837,935
British Pat. No. 466,763
British Pat. No. 486,930
U.S. Pat. No. 2,162,619
U.S. Pat. No. 2,391,728
U.S. Pat. No. 2,685,346
U.S. Pat. No. 2,774,663
U.S. Pat. No. 2,789,047
U.S. Pat. No. 2,810,636

The prior art defined in this background information deals principally with the thermal production of sodium, the production of combustible gases which may be utilized specifically as a source of thermal energy being incidental to the process. While many dozens of processes involving an equal number of variations in chemistry for thermal production of sodium are described in the prior art, the particular procedures which appear to have been emphasized are those which involve the reduction of a compound of sodium with either carbon or metallic iron. In some cases, a minor amount of metallic iron, usually of the order of 2 percent of the carbon is added along with the carbon to catalyze the reduction process. It is further recognized in the prior art that the order to prevent adverse back reactions between the metallic sodium and the carbon monoxide produced that the products of the reaction must be removed rapidly from the reaction zone and cooled quickly to prevent the adverse back reaction which detracts from the efficiency of the process. Other claimed adverse back reactions include the reaction of the alkali hydroxide with carbon monoxide to produce the carbonate of the alkali metal, an undesired reaction if the function of the reaction is the production of metal. In addition, the excessive temperatures at which the prior art reactions are carried out produces significant portions of the sodium compounds used as the source of the metallic sodium in sublimed or gaseous form which then pass through the reaction zone and are condensed along with the metallic sodium produced, thereby not only again detracting from the efficiency for the reaction for the production of sodium but also producing an impure production of metallic sodium contaminated with very substantial quantities of compounds of sodium which have to be subjected to specialized and expensive treatments requiring recycling in order to produce commercially effective yields of metalic sodium.

Procedures desired in the prior art involve the requirement for rapid removal of the products of the reaction from the reaction vessel coupled with shock cooling to reduce the back reaction between metallic sodium, volatilized compounds of metallic sodium and carbon monoxide which detract from the efficiency of production of the thermally produced metallic sodium. Techniques for alleviating these difficulties at least to a partial extent have been the utilization of reactors operating under reduced pressure or by sweeping the reaction zone with dry hydrogen, coupled with shock cooling of the sodium metal produced.

Typical of some of the problems encountered in the thermal production of sodium through prior art procedures are the disclosures given in U.S. Pat. Nos. 2,774,663 and 2,810,636 in which cyclic processes for the production of sodium are described involving the formation of an excessive amount of dross, usually in the form of sodium carbonate, which is collected along with the sodium coupled with the volatilization of sodium hydroxide and the need for the addition of extra amounts of sodium hydroxide to the sodium carbonate containing sodium in order to produce a molten mixture which can be recycled. In carrying out this recycling in the manner described in the aforementioned patents sodium carbonate is again produced which has, again, to be reacted over again, thereby again detracting from the efficiency of the reaction by virtue of the requirement of the need for excessive amounts of heat needed to reduce much more reagent than is necessary.

Though an overall recovery of more than 90 percent is claimed these processes could not be considered as efficient producers of carbon monoxide and hydrogen in view of the excessive amount of heat required for such products due to the need for recycling of reagents in an undesired manner, by overly expensive procedures.

DESCRIPTION OF THE INVENTION

I have found that by using appropriate combinations of reagents under condition which permit these reagents to react with each other effectively, instantaneously and completely and ensuring that the overall temperature in the reactors used does not exceed 850° C. coupled with rapid removal and shock cooling of the gaseous products of the reaction that substantially all of the adversities detracting from the chemical and thermal efficiency of the prior art are not only obviated but also recovery of the desired carbon monoxide and hydrogen as sources of combustible fuel are achieved with the material efficiencies in excess of 94 percent and with thermal efficiencies superior to any of those described in the prior art by virtue of controlled application of heat into the area where such heat operates with greatest effect.

This is accomplished by initiating the reaction between (1) molten alkali metal at a temperature of the order of 350° C. in one spray stream and (2) a slurry comprising superheated stream with carbon in separate streams which is pumped into a first reaction chamber and then into a semifluid bed chamber containing finely divided powdered iron, cobalt, nickel or manganese oxides of said metals, alloys of said metals, or mixtures of said metals in which such chambers are maintained at a temperature not exceeding 850° C. Alternatively, a third reagent in the form of heated carbon dioxide may also and preferentially be pumped into the reaction chamber. The water, carbon and carbon dioxide streams are also fed at a temperature of 350° C. These reagents are pumped into a first reaction zone in such a manner that all of the spray jets are commingled just prior to entering the semifluidized bed containing metallic iron and/or an oxide of iron, or the preferred equivalent mixtures of metals and/or oxides defined previously. All sprays except that of the alkali metal are introduced tangentially in order to yield a pronounced vortex action in the first reaction chamber. A hypergolic reaction developing an excessive gas pressure is thus initiated in the first reaction zone. The gaseous products of the reaction obtained after passing through the semifluidized bed zone (which may be designated as the second reaction chamber), comprising chiefly sodium vapor, hydrogen, and carbon monoxide are passed to a condensor operating at a pressure of less than 0.5 atmospheres where the metallic sodium is shock cooled to a temperature not exceeding 380° C. and not dropping below a temperature of 200° C. Through heat exchange, heat is extracted from the products and added to the incoming reagents.

An advantage of the process is that a substantial excess of combustible gas producing reagents in the form of carbon, water and carbon dioxide without additional metallic sodium may be added to the reagents to produce extra quantities of combustible gas, again at high rates and without hindering the course of the reaction. These extra reagents permit a significant content of the familiar "water shift reaction" to be added on top the various reactions involving sodium or potassium. Further, the desired reducing conditions are ensured by maintaining an excess of reducing agent in the reactor through the medium of amounts of carbon and metals taken from the class of iron, cobalt, nickel and manganese, such excess being above that required for exact stoichiometry as may be defined by the equations which describe the various reactions taking place. These extra reagents also serve the function of maintaining the hypergolic reaction temperature so as to not exceed 850° C.

When the principal metallic reductant is metallic iron in powdered form, production of alkali metals just barely begins to take place at temperatures in the range of 850° C. to 950° C. If metallic reductants taken from the group of manganese, cobalt, and nickel are utilized as at least partial replacements for the iron, hydrogen production begins at temperatures as low as 350° C. with active alkali metal production taking place at temperatures as low as 550° C. to 650° C. Thus, the use of metals taken from the class of manganese, cobalt and nickel or combinations thereof as a replacement for a portion of the iron burden greatly facilitates the reaction by substantially reducing the temperature at which the reaction takes place. Since the carbon monoxide and hydrogen pass into the gaseous condition immediately, removal of these gaseous products from the reaction zone by utilization of reduced pressure is exceptionally rapid, compared to the slower volatilization of the metallic sodium, thereby again reducing the possibility for a back reaction between metallic sodium and carbon monoxide which detracts from the efficiency of the desired gas formation.

The commercial viability of the cyclic process described is not only a function of the purity of the carbon which is utilized as one of the reductants but further is a function of special treatments which need to be carried out in the reactor in the event that impure types of carbon such as coal are used as reactants.

An ideal material as a carbon source is ash-free calcined petroleum coke. Use of such a reductant permits substantially indefinite recycling without adverse building up of adverse by-product nonproductive reactions. If the coke contains a significant amount of mineral contamination, then a sufficient amount of limestone needs to be added in order to produce a high melting point powder with the ash constituents of the coal requiring periodic tapping of the furnace to remove the undesired by-product powder which consists primarily of calcium silicates, sometimes containing substantial portions of calcium sulfide in the event that the coal contains high percentages of sulfur. The melting points of these by-products are substantially above 850° C. so that they can be removed from the reactor periodically as dry, free flowing powders.

In view of the fact that water is one of the reagents, high water content coals normally designated as brown coal or lignites may be utilized as the carbon source without the need for preliminary calcination of the coal for removal of such water and the volatile components of the coal represent a plus for the formation of gaseous energy producing fuels usually in the form of gaseous hydrocarbons and hydrogen.

Coke is a useful reductant if utilized in the presence of limestone. The preferred form of coke is the type normally designated in the trade as "coke breeze." Alternately, finely divided coke recovered from blast furnace dust is also useful.

Figure 2:
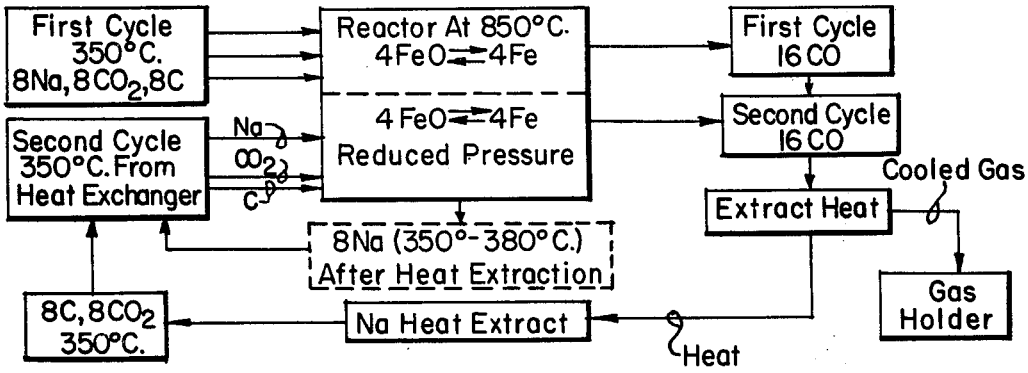
Figure 3:
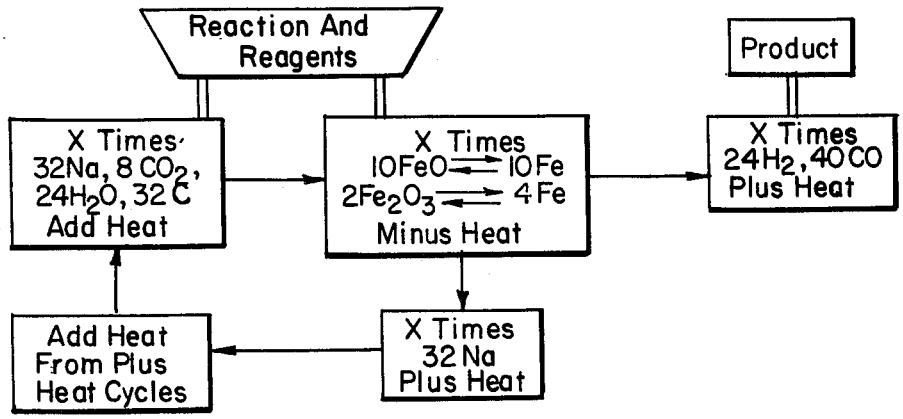

The basic reactions and reaction routings which take place are defined in Tables 1 through 7 and in FIGS. 1 through 3 following, which are block diagrams of the process.

Figure 4:
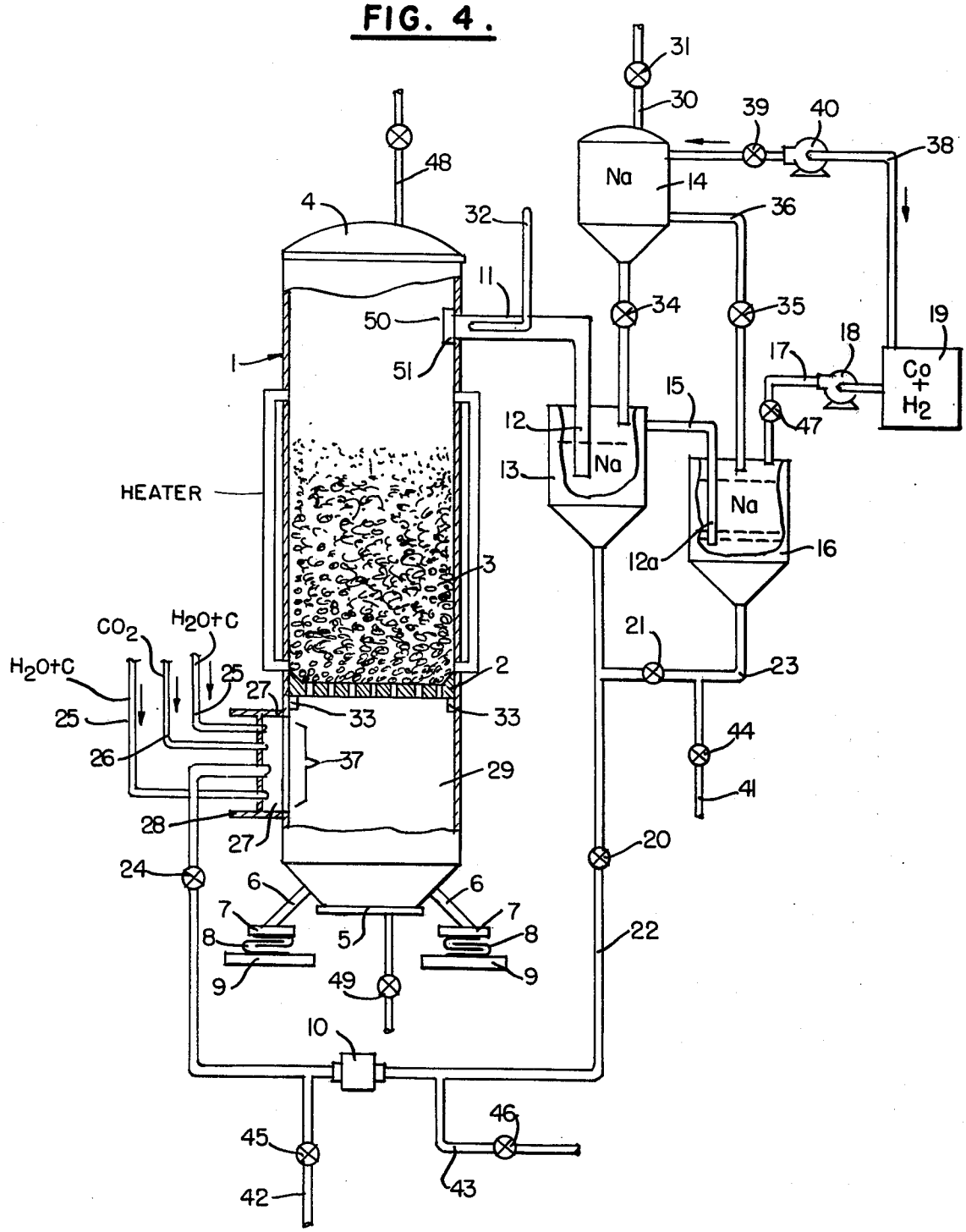

A schematic representation of the reactor in which the combustible gases are produced is depicted in FIG. 4. FIG. 4 is not drawn to scale. In addition, equipment items whose design and function are amply described in the prior art are not shown but will be defined in the description to follow. However, sufficient dimensional information will be provided so that the schematic representation may be considered in terms of proper scale.

TABLE 1

CHEMISTRY OF PRODUCTION OF CO AND $H_2$ FROM NaOH + C + Fe

Reaction Sequence A $$6\ NaOH + 6C \longrightarrow 6\ Na + 3H_2 + 6\ CO$$

$$6\ NaOH + 6\ Fe \longrightarrow 6\ FeO + 6\ Na + 3\ H_2$$

$$6\ FeO + 6\ C \longrightarrow 6\ Fe + 6\ CO$$

$$12\ Na + 12\ H_2O \longrightarrow 12\ NaOH + 6\ H_2$$

$$\text{Sum} = 12\ C + 12\ H_2O \longrightarrow 12\ CO + 12\ H_2$$

Reaction Sequence B $$6\ NaOH + 6\ C \longrightarrow 6\ Na + 3H_2 + 6\ CO$$

$$6\ NaOH + 4\ Fe \longrightarrow 2\ Fe_2O_3 + 6\ Na + 3H_2$$

TABLE 1-continued

| CHEMISTRY OF PRODUCTION OF CO AND $H_2$ FROM NaOH + C + Fe |
|---|
| $2\ Fe_2O_3 + 6\ C \longrightarrow 4\ Fe + 6\ CO$ |
| $12\ Na + 12\ H_2O \longrightarrow 12\ NaOH + 6\ H_2$ |
| $Sum = 12\ C + 12\ H_2O \longrightarrow 12\ CO + 12\ H_2$ |

TABLE 2

| GAS PRODUCTION FROM CEMISTRY IN TABLE 1(A OR B) | |
|---|---|
| 9.49+ | Standard cubic feet of $H_2$ (12 moles of $H_2$) |
| 9.49+ | Standard cubic feet of CO(12 moles of $O_2$) |

TABLE 3

| CHEMISTRY OF PRODUCTION OF CO FROM $Na_2CO_3$ + Fe + C + $CO_2$ |
|---|
| $2Na_2CO_3 + 4C \longrightarrow 4Na + 6CO$ |
| $2Na_2CO_3 + 4Fe \longrightarrow 4Na + 4FeO + 2CO$ |
| $8Na + 8CO_2 \longrightarrow 4Na_2CO_3 + 4CO$ |
| $4FeO + 4C \longrightarrow 4Fe + 4CO$ |
| $Sum = 8C + 8CO_2 \longrightarrow 16CO$ |

TABLE 4

| GAS PRODUCTION FROM CHEMISTRY IN TABLE 3 |
|---|
| 12.66 Standard cubic feet of CO (16 moles of CO) |

TABLE 5

| COMBINATION OF REACTION SEQUENCE A (TABLE 1 AND TABLE 3) | |
|---|---|
| $Sum = 20C + 12H_2O + 8CO_2 \longrightarrow 28CO + 12H_2$ | (A) |
| COMBINATION OF REACTION SEQUENCES A AND B (TABLE 1 AND TABLE 3) | |
| $Sum = 32C + 24H_2O + 8CO_2 \longrightarrow 40CO + 24\ H_2$ | (B) |

TABLE 6

| GAS PRODUCTION FROM CHEMISTRY IN TABLE 5 |
|---|
| FROM REACTION SEQUENCE A (TABLE 1) and TABLE 3 |
| 22.15 Standard cubic feet of CO (28 moles of CO)<br>9.49 +Standard cubic feet of $H_2$(12 moles of $H_2$) |
| FROM REACTION SEQUENCES A AND B (TABLE 1) and TABLE 3 |
| 31.64 Standard cubic feet of CO(40 moles of CO)<br>18.99 Standard cubic feet of $H_2$(24 moles of $H_2$) |

TABLE 7

| ADDITION OF EXTRA C, $H_2O$ AND $CO_2$ |
|---|
| $6C + 6H_2O \longrightarrow 6CO + 6H_2$ |
| $6C + 6CO_2 \longrightarrow 12CO$ |
| $Sum = 12C + 6H_2O + 6CO_2 \longrightarrow 18CO + 6H_2$<br>= 4.75 Standard cubic feet of $H_2$(6 moles)<br>= 14.24 Standard cubic feet of CO(18 moles) |

The reactor proper 1 is made of ⅜" thick Armco iron of welded construction. Metals such as nickel or nickel clad Inconel or zirconium stabilized Nichrome are useful alternates. The reactor 1 is maintained at operating temperature by wrapping the exterior of the reactor (not shown) with high temperature ceramic coated resistance wire and the exterior of the ceramic coated resistance wire is insulated to drive the heat inwards toward the reactor. Alternately, the reactor may be heated by induction. The inside diameter of the reactor is 12" and the inside height of the reactor in its longest dimension is 48". A ring 33 having a cross section of 1" by 1" is welded to the inside of the reactor in the position indicated so that the top of such ring is 12" from the bottom of the reactor. Placed on top this ring is a perforated flat bottom dish shaped plate 2, 1" in thickness in its flat portions and 3" high on the raised edges. The perforated dish 2 is drilled with holes as shown, 3/32" each in diameter on ⅓" centers, such holes being made only on the flat portions of the dish. Both ring 33 and dish 2 are also made of Armco Iron. The reactor 1 is loaded above with a graded series of Armco iron balls 3 through the tight sealing removable cover 4, such graded series varying regularly in size from 1" in diameter to ⅛" in diameter. A bed of iron balls approximately 16" thick is provided as follows: a first double layer of 1" balls; followed by four layers of ¾" balls; six layers of ½" balls, eight layers of ¼" balls; and finally topped off with a 6" to 8" thick layer of ⅛" balls. The balls are hollow or porous to reduce weight. The approximate height of the total ball containing bed is approximately 16" deep. The top of the bed is 8" below the gas outlet 11 said gas outlet being 5" in diameter. The distance between the top of the ball bed layer and the removable tight sealing removable cover 4 is 19". The removable cover 4 is 6" in diameter which when in use, is bolted down against a copper gasket (bolts and gaskets not shown). The reactor above the perforated plate 2 is designated as the second reactor zone.

The first reactor zone 29 is 12" deep from the bottom of the perforated plate 2 to the inside of the discharge opening 5 in which 5 again is a tight sealed removable cover 2" in diameter held in place with bolts and copper gasket, said bolts and copper gasket not shown.

The reactor 1 is held in place with four 1" diameter iron legs 6 equally spaced around the bottom of the reactor. Each leg is welded to a ½" thick iron plate 3" in diameter 7 set on top a firm iron plate foundation 9 1" thick which is bolted to the floor. Between plate 7 and foundation 9 is placed a magnetically actuated vibrator 8 of known design operating at frequencies of at least 1000 cycles per second through an amplitude not exceeding 0.5 mils and preferably maintained at 0.1 mils. Similar foundations and vibrators (not shown) are situated under all other unit process pieces of equipment so that the entire assembly of FIG. 4 can be made to vibrate in unison, if desired, to prevent undue strain on piping and couplings.

Loop 32 is a heat exchanger constructed of iron using liquid gallium as the heat exchange fluid which enables the gases coming from reactor 1 through conduit 11 to be cooled to a temperature not exceeding 380° C. Other fluids such as metallic sodium, biphenyl and standard heat exchange media may be used instead. Mechanical pumps are used for all fluids except metallic sodium which is magnetically pumped. The pumps are not shown. The heat extracted at this stage is transferred to the feeding devices 25 and 26 through which the non-sodium reagents are fed into the vortex chamber 29. This heat transfer device is not shown.

The cooled gases consisting primarily of very fine droplets of metallic sodium, carbon monoxide and hydrogen pass into a fluted condensor (iron) 12 where the sodium is coalesced into a liquid state and thence into the insulated iron container 13 maintained at a temperature not exceeding 350° C. and not below 200° C. The magnetically activated internal valves 20, 21, 31, 24, 34 and 35 are appropriately opened and closed as defined later. The internal capacity of the container 13 is 5 gallons up to the dashed line.

Since sodium, potassium, and mixtures thereof have a small but significant vapor pressure at 350° C., a second condensor is provided in which the off-gases now consisting chiefly of carbon monoxide and hydrogen with a minute amount of entrained alkali vapor are passed through conduit 15 into the fluted condensor 12A cooling these gases to a temperature in the range of 125° C. to 150° C., at which temperature the vapor pressure of the alkali metals is miniscule. The container 16 again has a capacity of 5 gallons up to the top dashed line and a capacity of ½ gallon up to the double dashed line.

The off-gases, now consisting of a substantially pure mixture of carbon monoxide and hydrogen, are pulled from the container 16 through the conduit 17 by means of a totally sealed graphite vane pump 18 of speed and capacity so that a pressure of 0.1 to 0.5 atomspheres is maintained from the interior of reactor 1 at position 3 up to the exhausting face of the vane pump 18.

Carbon monoxide and hydrogen are passed to the gas holder 19 in which the sealing liquid at room temperature is purified mineral oil, of specific gravity equal or less than 0.90, containing no additives. Purified mineral oil is chosen as the gas holder sealant since it does not react with alkali metal which may enter the gas holder fortuitously and any vapor pressure it might exhibit will represent a beneficial additive to the desired combustible gas product.

Chamber 14 is an insulated iron container of 5 gallon capacity to which is fed 30 pounds of molten sodium or potassium or mixtures thereof, to be used later for start up and balancing purposes through pipe 30. The alkali metal is fed into the container 14 through the magnetically activated valve 31 while valves 34 and 35 are in the closed condition. Such alkali metal is maintained at a temperature between 200° C. and 350° C. Pipe 38 leads back to the top of the gas holder 19 not only to provide a backup pressure forcing gaseous medium of carbon monoxide and hydrogen entering at atmospheric or superatmospheric pressure, but also to ensure appropriate pressure balancing means while the gas forming reactions are in progress in reactor 1. To accomplish this operation, valve 39 is either opened at will or automatically when the gas pressure in front of the valve exceeds 0.5 atmospheres. Whenever valve 39 is open, pump 40 is started automatically to pump gas from the top of gas holder 19 into chamber 14.

All valves such as 31, 34, 35, 21, 20 and 24 through which molten alkali passes are totally internal magnetically activated flip type devices of known construction. All piping for molten alkali such as 11, 15, 17, 36, 23 and 22 are made of externally insulated Armco iron of 1" inside diameter and 3/16" wall thickness with the exception of conduit 11 which has an inside diameter of 5" and a wall thickness of ⅜".

The molten alkali metal at a temperature of 350° C. is pumped concentrically with a magnetic pump 10 into the vortex nozzle 37 which ejects such molten metal into the first reaction chamber 29 which is maintained at a temperature not exceeding 850° C. with appropriate opening and closing of valves as will be described in Example 1. The balance of the vortex nozzle 37 consists, first, of a 5" diameter iron tube 27 of ⅜" wall thickness made of iron welded through the wall of the reactor 1 so as to permit access to chamber 29. Lines 25 and 26 are ½" internal diameter iron of ⅛" wall thickness through which reagents other than the alkali metals, such as carbon, steam, carbon dioxide and sometimes limestone are fed tangentially into the vortex nozzle. Solids are in powder form of particle size not exceeding 25 microns. These reagents are fed into the nozzle from pressure chambers and pressurized mixing chambers fitted with pumps, all of known design, and not depicted in FIG. 4, which enables such reagents to be fed into the nozzle at temperatures in the range of 200° C. to 350° C. These feed chambers are maintained in this temperature range by heat exchange devices (not shown) whose heat is supplied by loop 32. The vortex nozzle assembly 37 is sealed into the tubulature 27 by welding into appropriate perforations in the flange 28 which in turn is welded into the inside of tubulature 27.

The gas holder 19 has a gas capacity of 1000 cubic feet above the sealant level and is used primarily as an overflow device into a second gas holder of at least 100,000 cubic feet capacity (not shown) from which combustible gas can be drawn for end use purposes. This combination of gas holding devices is a further aid for pressure balancing purposes.

Outlet 41 and valve 44 and outlet 42 with valve 45 are drain ports for gravity removal of molten alkali from the system when desired or necessary. Inlet 43 with valve 46 represents a means for purging the system of air and replacing the atmosphere with hydrogen, carbon monoxide, or a mixture of the two. This is accomplished by closing off valves leading to lines 25 and 26; closing valves 31, 39, 47, 44 and 45; opening valves 24, 20, 21 and 34. After the system is partially loaded in a manner to be described later, purging is accomplished by evacuating the system through port 43 and valve 46 and replacing the air thus removed with hydrogen, carbon monoxide or a mixture of the two through a bypass to 43 (not shown). This purging process is repeated twice, after which valve 46 is closed.

EXAMPLE 1A—START-UP

The reactor assembly is empty except for sealant in the gas holders 19. Reactor 1 is then loaded with iron balls as heretofore described through the opened cover 4. On top the layer of ¾" balls is placed a 4 lb. layer of calcined petroleum coke which has been crushed to pass a screen of 4 mesh (Tyler) size so that all the coke is minus 4 mesh. On top of this layer is placed 3 layers of the ½" iron balls followed by a layer of 3 lbs. of minus 300 mesh powdered metals comprising a mixture of equal weights of iron, cobalt, nickel and manganese.

Cover 4 is closed and the entire system is then purged of air with dried tank hydrogen up to closed valves 39 and 47. The gas holder 19 is then loaded with 200 cubic feet of carbon monoxide and hydrogen from an outside source in the ratio of 3 volumes of carbon monoxide to 1 volume of hydrogen.

Next valves 34 and 35 are closed and valves 39 and 31 are opened. All other valves are closed. Simultaneously, container 14 is loaded with 30 lbs. of molten sodium at 200° C. through conduit 30 while pump 40 removes hydrogen gas from container 14 at a rate equal to the volume of the molten sodium being added. Once loading is completed, valve 31 is closed. Now, valves 35 and 47 are opened and pump 18 is actuated while valve 39 is closed and pump 40 is stopped. Loading of sodium is continued into chamber 16 until 10 lbs. of metal have been added. Valve 35 is then closed and valve 34 is then opened until chamber 14 is empty and chamber 13 contains 20 lbs. of molten sodium. The molten metal in chamber 16 is eventually maintained at a temperature of 135° C. and in chamber 13 eventually at a temperature of 350° C.

In the meanwhile, reactor 1 and its contents have been heated to 850° C. while valves 34, 47 and 39 are open and all other valves are closed. Valve 39 is opened to permit gas to be moved towards the left with pump 40 turning in the appropriate direction while pump 18 is moving gas towards the gas holder. Heat exchanger 32 is in the "on" condition while chamber 13 is heated to 350° C. and chamber 16 is maintained at 135° C. Gas pressure balancing is thus maintained while reactor 1 is being heated to temperature.

The system is now in condition for initiating the gas forming reaction.

The reactor depicted in FIG. 4 is a dynamic steady state device in which material flow is regulated by flow meters of known design in calibrated form. The flow of the molten alkali metals is regulated by the controlled action of the magnetic pump 10.

While the finely divided carbon source may be fed directly as a gas or liquid borne slurry, the most convenient and accurate technique is the use of aspiration into the tubulatures 25 or 26. This is accomplished by placing a side arm (not depicted) onto 25 or 26 just prior to position of flange 28. Such side arm connects to a container (not depicted) from which the air has been displaced with hydrogen. By vibrating the container at a controlled rate, the powdered reagent is fed into the vortex nozzle 37 and the first reaction zone 29. The containers for the powder are fitted with valved ports for filling purposes and backup pressure inlets where carbon dioxide gas is the equalizing pressure medium.

Water is fed to the reactor at temperatures in the range of 90° C. to 350° C. at nozzle pressures of the order of 100 lbs. per square inch. When water is injected at temperatures below its boiling point some or all of the carbon is fed to the reactor in the form of a well stirred slurry from a stirred pressure type vessel of known design. This situation obtains when pure carbon such as calcined ash-free petroleum coke is utilized. When impure sources of carbon are used such as lignite only part of the carbon can be injected with the water, and the balance in the form of powdered lignite by aspiration. The carbon dioxide is fed to the reactor at a temperature of 350° C., also at nozzle pressure of the order of 100 lbs. per square inch. Water above its boiling point is utilized as dry steam. As indicated previously, the reagents with the exception of the molten alkalis, are heated to the desired temperature by heat interchange from exchanger-coil 32.

The molten alkali metal, which is already at a temperature of 200° C. to 350° C., is pumped from container 13 with occasional admixture of metal from container 16 via a line 22 at an internal pressure not exceeding 10 lbs. per square inch. The exit concentric molten alkali nozzle at 37 has an opening of approximately 0.08 square inches which provides a nozzle pressure of approximately 100 lbs. per square inch.

As a consequence of the recited conditions, all the products of the reaction in chamber 29 are in gaseous or extremely fine mist form. In view of the reduced pressure imposed by pump 18, these products pass almost immediately into the vibrated bed 3.

The production of hydrogen is substantially quantitative practically immediately based on measurements of gas samples reduced to standard conditions taken at the inlet to gas holder 19 within 5 minutes after the start of the reaction, while the production of carbon monoxide becomes quantitative after about 10 minutes which apparently is the time required to reach steady state conditions in zone 3 of reactor 1. The term "quantitative" refers to the stoichiometry depicted in Tables 1 through 7 and the equations therein. In view of the dynamic operation of the system an exact figure for gas production is difficult to determine at any exact moment in time at the gas holder inlet area but samples taken from the gas holder itself 19 indicate that under steady state conditions, the production of gas represents a yield between 95 and close to 100 percent of theoretical based on the combined equations given in Tables 1, 3 and 7.

Obviously, the relative ratios of carbon monoxide and hydrogen can be varied by appropriate combinations of variations of Tables 1, 3 and 7 since carbon monoxide only is produced from the chemistry given in Table 3.

Access to reaction chamber 1 for addition and/or removal of reagents and/or undesired by-products is made available through valved ports 48 and 49. Passage of dust into the molten alkali condensor containers is prevented by welding a 300 mesh iron screen 50 onto the face of tubulature 51. Normally, such gas borne dust problem does not occur except when channeling takes place which sometimes occurs in the upper portions of the fluidized bed. A slight and temporary increase in amplitude of vibration through vibrator 8 remedies the difficulty.

EXAMPLE 1B—OPERATION

The conditions as defined in 1A are established. Simultaneously valves 34, 47, 20, 21 and 24 and those leading to lines 25 and 26 are opened with valve 39 and pump 40 actuated to initiate action to the left when the gas pressure reaches 0.5 atmospheres at the same time pumps 18 and 10 are actuated.

Molten sodium at 350° C. is injected into chamber 29 through the vortex nozzle 37 at the rate of 1.5 lbs. of metal per minute. Carbon in the form of ash-free calcined petroleum coke in the amount of 0.77 lbs. per minute is fed as a slurry mixed with water in the amount of 0.58 lbs. per minute at a temperature of 95° C. Carbon dioxide gas is fed at the rate of 1.412 lbs. per minute at a temperature of 350° C.

These reagent feeding conditions are maintained for 15 minutes. Thereafter, pump 10 and the pumps actuating lines 25 and 26 are stopped, followed immediately by reversal of pump 10 for 15 seconds after which valve 24 is closed along with stoppage of pump 10. The exhausting action of pump 18 is accelerated to yield a pressure of 0.1 atmospheres and continued for 10 minutes longer after which pumps 18 and 40 are stopped along with closure of valves 39 and 47.

After corrections for volumes of gas left in gas holder at start up and its analysis reduced to standard conditions, it was found that 659 cubic feet of gas at standard conditions was produced which represents a gas volume yield of approximately 95.5 percent of theoretical. Analysis shows that this gas exhibited a ratio of carbon monoxide to hydrogen of 2.81, whereas the theoretical quantitative ratio at 100 percent yield would have been 3.00, defining that the majority of loss of yield from theoretical was due to a slightly less than quantitative yield of carbon monoxide along with a quantitative yield of hydrogen. Actual yields were 173 cubic feet of hydrogen and 486 cubic feet of carbon monoxide.

EXAMPLE 2

Start up conditions as in Example 1A were reestablished and the procedure of Example 1B carried out except that the molten sodium was replaced with molten potassium. All conditions of Example 1B were maintained except that the potassium was fed at the rate of 2.55 lbs. per minute. A residual gas volume of 679 cubic feet at standard conditions was produced showing a carbon monoxide-hydrogen ratio of 2.92 corresponding to an overall gas volume yield of 98.4 percent.

EXAMPLE 3

Same as Example 1B except that the carbon was aspirated into the reaction chamber and the water was fed to the reaction in the form of dry steam at a temperature of 350° C. A gas yield of 676 cubic feet was obtained (at standard conditions) equivalent to a yield of 98 percent of theoretical.

EXAMPLE 4

Coke breeze ground to a particle size of less than 25 microns having the proximate analysis shown in Table 8 is used as the carbon source and is fed at the rate of 0.96 lbs. per minute along with 0.04 lbs. per minute of equally fine limestone, and in accordance with the teachings of Example 3. A gas yield of 652 standard cubic feet was obtained equivalent to 94.5 percent of theoretical.

TABLE 8

| PROXIMATE ANALYSIS OF COKE BREEZE | | |
|---|---|---|
| C | = | 80.0 |
| Fe | = | 5.0 |
| Mn | = | 0.04 |
| $SiO_2$ | = | 7.4 |
| $Al_2O_3$ | = | 2.8 |
| CaO | = | 1.8 |
| MgO | = | 0.6 |
| S | = | 0.6 |
| $H_2O$ | = | 1.7 |

After the reaction was completed to the full stop condition and all valves closed, gas was fed from the gas holder 19 into the reactor through pipe 48 until a pressure of 1 atmosphere was obtained. Gas flow was then stopped and the valve in pipe 48 closed. A chamber containing an atmosphere of carbon monoxide and hydrogen taken from the gas holder was attached to pipe 49. The valve in pipe 49 was opened and the reactor was then vibrated with an amplitude of 0.2 mils at 2000 cycles per second from position (8) for 15 minutes. Valves at 49 and in the collecting chamber were closed. The collecting chamber was removed, cooled to room temperature, and the contents in the form of a grey-black fine powder was magnetically separated. The magnetic portion along with 3 lbs. of −16 mesh (Tyler) calcined petroleum coke was added back to the reactor through pipe 48, after which the valve in pipe 48 was closed. The reactor was vibrated for 5 minutes at an amplitude of 0.1 mils at 1000 cycles per second and the gas forming reaction as previously described in this example was reinitiated with approximately the same yield of gas as before, indicating that the procedure used was adequate for placing the reactor back into operating condition.

The nonmagnetic fraction weighed 2.30 lbs. and analysis indicated that it comprised a major amount of the silicates of lime, magnesia and alumina plus a minor amount of the sulfide of lime. These results indicate that the reactor can be run for 45 to 75 minutes before clean-out is required. Further, it appears that continuous removal and refilling is possible in a dynamic sense by appropriate manipulation of amplitude and speed of vibration while reagent injection is in the full stop condition.

EXAMPLE 5

Same as Example 4 except that the source of carbon used was a semibituminous Montana coal in finely ground state having the analysis given in Table 9. The coal was fed at the rate of 1.28 lbs. per minute along with 0.04 lbs. of finely ground limestone per minute. A gas yield of 697 of standard cubic feet of gas was obtained presumably equivalent to about 101 percent of theoretical. However, the gas analysis indicated that the hydrogen yield was approximately 104 percent of theoretical and the carbon monoxide yield was about 97.5 percent of theoretical. Apparently, the extra hydrogen comes from hydrocarbons present in the coal. Also, the gas was found to contain approximately 0.7 percent of nitrogen by volume.

TABLE 9

| COMBINED PROXIMATE ANALYSIS OF SEMIBITUMINOUS COAL | | | | | |
|---|---|---|---|---|---|
| (A) | | | (B) | | |
| C | - | 60.0 | Fixed C | = | 43.7 |
| H | - | 5.6 | Volatiles | = | 34.7 |
| N | - | 1.3 | $H_2O$ | = | 10.5 |
| 0 | - | 21.0 | Ash | = | 11.2 |
| S | - | 1.1 | | | |
| $H_2O$ | - | 10.5 | | | |

I claim:

1. A reactor for producing at least one gas selected from the group consisting of $H_2$, CO and mixtures thereof by oxidation of an alkali metal and subsequent reduction of the oxidized alkali metal, said reactor comprising in combination:

a vertical reaction vessel (1) mounted on a foundation;

a horizontally disposed foraminous means (2) in said vessel separating the interior of the vessel into a first reaction zone below said foraminous means and a second reaction zone above said foraminous means and adjacent to said first reaction zone;

a fluidizable bed (3) of light weight iron balls supporting particulate material selected from the group consisting of metallic iron, nickel, cobalt, manganese, oxides of said metals, alloys of said metals and mixtures of said metals, their oxides and their alloys, in said reaction vessel, supported within said reaction zone by said foraminous means;

means (10) for spraying a stream of molten alkali metal into said first reaction zone;

means (25) for introducing a stream of finely divided carbon and oxidant into said first reaction zone;

means (37) for mingling said fluid stream of oxidant and carbon with said stream of alkali metal in said first reaction zone, to effect oxidation of said alkali metal;

an outlet conduit (11) connected to the second reaction zone in said reaction vessel;

means (18) for maintaining a reduced subatmosphere pressure in said outlet conduit whereby the materials sprayed into said first reaction zone and their reaction products are caused to flow into said second reaction zone and through said fluidizable bed;

heating means associated with said vessel for maintaining the said zones in said reaction vessel at an elevated temperature; and means (13) communicating with said outlet conduit to separately recover the reaction products issuing through said outlet conduit.

2. The apparatus of claim 1 including in addition means (12) in said outlet conduit to shock cool the reaction products.

3. The apparatus of claim 1 wherein the reaction vessel mounted on a foundation includes a means (18) for vibrating the reaction vessel through a small amplitude at moderate frequencies.

4. The apparatus of claim 1 wherein the balls in said fluidizable bed (3) are hollow and/or porous metal balls.

5. The apparatus of claim 1 including in addition at least one condenser (16) connected to said outlet conduit for storing alkali metal recovered from the reaction products withdrawn through said outlet conduit.

6. The apparatus of claim 5 including in addition a gas holder (19) connected to said condenser, for collecting the gaseous reaction products discharged through said outlet conduit.

* * * * *